US006941104B2

(12) United States Patent
Miura

(10) Patent No.: US 6,941,104 B2
(45) Date of Patent: Sep. 6, 2005

(54) CARRYING APPARATUS AND IMAGE FORMING APPARATUS

(75) Inventor: Tatsuyuki Miura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/814,145

(22) Filed: Apr. 1, 2004

(65) Prior Publication Data

US 2004/0165921 A1 Aug. 26, 2004

Related U.S. Application Data

(63) Continuation of application No. 10/406,459, filed on Apr. 4, 2003, now Pat. No. 6,798,998, which is a continuation of application No. 09/922,704, filed on Aug. 7, 2001, now Pat. No. 6,564,035.

(51) Int. Cl.[7] ..... G03G 15/00

(52) U.S. Cl. ..... 399/401; 271/265.02; 271/902; 399/16

(58) Field of Search ..... 399/401, 124, 399/388, 16; 271/265.02, 265.01, 264, 225, 902

(56) References Cited

U.S. PATENT DOCUMENTS 4,979,727 A 12/1990 Koike et al.
5,815,772 A * 9/1998 Saito et al. ..... 399/401 X
5,833,227 A 11/1998 Choho et al.
5,872,900 A 2/1999 Tsuchitoi
5,953,575 A * 9/1999 Park et al. ..... 399/401
6,041,213 A * 3/2000 Yanagi ..... 399/401
6,134,404 A 10/2000 Iwai et al.
6,275,676 B1 8/2001 Ushio
6,424,365 B1 * 7/2002 Kimoto ..... 399/401 X
6,477,352 B2 11/2002 Takahashi et al.

FOREIGN PATENT DOCUMENTS

JP 02-176766 * 7/1990
JP 3-100565 A 4/1991
JP 9-25040 A 1/1997

* cited by examiner

*Primary Examiner*—Sophia S. Chen
(74) *Attorney, Agent, or Firm*—Foley & Lardner LLP

(57) ABSTRACT

The carrying apparatus includes a carrying device for carrying an object to be carried, along a carrying route having a corner part, a control device for temporarily stopping and holding the object carried by the carrying device, and a detection device for detecting the object positioned at a corner part of the carrying route, wherein if the detection device detects the object when the control device stops carrying the object, the control device controls the carrying device such that the carrying device carries the object until the detection device does not detect the object any more and the carrying device then stops carrying the object.

9 Claims, 6 Drawing Sheets

CARRYING APPARATUS AND IMAGE FORMING APPARATUS

The present application is a continuation of Ser. No. 10/406,459, filed Apr. 4, 2003 now U.S. Pat. No. 6,798,998, which is a continuation of application Ser. No. 09/922,704, filed Aug. 7, 2001 now U.S. Pat. No. 6,564,035, and the entire contents of each such application are incorporated herein by reference.

BACKGROUND OF THE INVENTION

The present invention relates to a carrying apparatus for conveying a paper sheet and an image forming apparatus which are comprised, for example, in an electrophotographic copying machine.

In many electrophotographic copying machines, images can be formed on both surfaces of a paper sheet. To form images on both surfaces in this kind of copying machine, a paper sheet is supplied from a paper sheet feed cassette to an image forming section through a paper sheet carrying route (hereinafter simply called an ADU), and an image is formed on one surface. The paper sheet on which an image has been formed is then stacked and contained in an intermediate tray. Subsequently, the paper sheet stacked and contained in the intermediate tray is fed again to the image forming section, and an image is then formed on its back surface. Thus, images are formed on both surfaces of a paper sheet which is then fed out onto a sheet discharge tray.

Meanwhile, electrostatic charges have been applied to paper sheets stacked on the intermediate tray, for example, through a transfer process at the image forming section. Therefore, paper sheets easily tend to be fed stuck together when they are fed again from the intermediate tray.

In addition, since a paper sheet having a surface on which an image has been formed must once be stacked and contained in the intermediate tray, an image cannot be formed sequentially on its back surface. Time loss is therefore caused so that the image forming efficiency is lowered.

To solve the above-described problems that layered paper sheets are fed and the image forming efficiency is lowered, a development has been made in an electrophotographic copying machine which adopts so-called non-stack ADU.

That is, this kind of electrophotographic copying machine carries out continuous image formation on surfaces of a plurality of sheets, excluding the intermediate tray from the ADU. Then, these paper sheets are directly sent to the image forming section, reversed by reverse carrying means, and an image is formed on the back surface of the paper sheet.

In some cases, the non-stack ADU is used with an accounting device such as a coin controller attached thereto. If data of total 4 pages are double-side-printed on two paper sheets in an electrophotographic copying machine attached with the accounting device, for example, there may be a case that inserted money runs short at the time point when printing on pages 1, 2, and 4 pages.

In this case, the paper sheet on which the third page should be printed should be discharged without carrying out printing or should be kept in the ADU in the apparatus.

However, the non-stack ADU includes a curved corner part. If a paper sheet is kept at this corner part, the paper sheet is curled into the shape of the corner part.

The appearance of the paper sheet is deteriorated and a transfer failure may occur. In addition, paper sheets cannot be discharged, with their order arranged properly, and there may be a drawback that paper sheets jam while conveying them.

BRIEF SUMMARY OF THE INVENTION

The present invention has been made in view of the actual situation as described above, and has an object of providing a carrying apparatus and an image forming apparatus which are capable of carrying an object to be carried (to which an image should be transferred) in excellent condition, without curling the object, even if the object is temporarily stopped and held.

A carrying apparatus according to the present invention comprises: a carrying device for carrying an object to be carried, along a carrying route having a corner part; a control device for temporarily stopping and holding the object carried by the carrying device; and a detection device for detecting the object positioned at a corner part of the carrying route, wherein if the detection device detects the object when the control device stops carrying the object, the control device controls the carrying device such that the carrying device carries the object until the detection device does not detect the object any more and the carrying device then stops carrying the object.

An image forming apparatus according to the present invention comprises: an image forming device for forming an image on an image carrier; a transfer device for transferring the image formed by the image forming device, to an object to which the image should be transferred; a reverse carrying device for carrying the object having a surface to which the image has been transferred, along a reverse carrying route having a corner part, thereby to reverse and feed the object again to the transfer device; a control device for temporarily stopping and holding the object carried by the reverse carrying device, if necessary; and a detection device for detecting the object positioned at the corner part of the reverse carrying route, wherein if the detection device detects the object when the control device stops carrying the object, the control device controls the carrying device such that the carrying device carries the object until the detection device does not detect the object any more and the carrying device then stops carrying the object.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Figure 1:
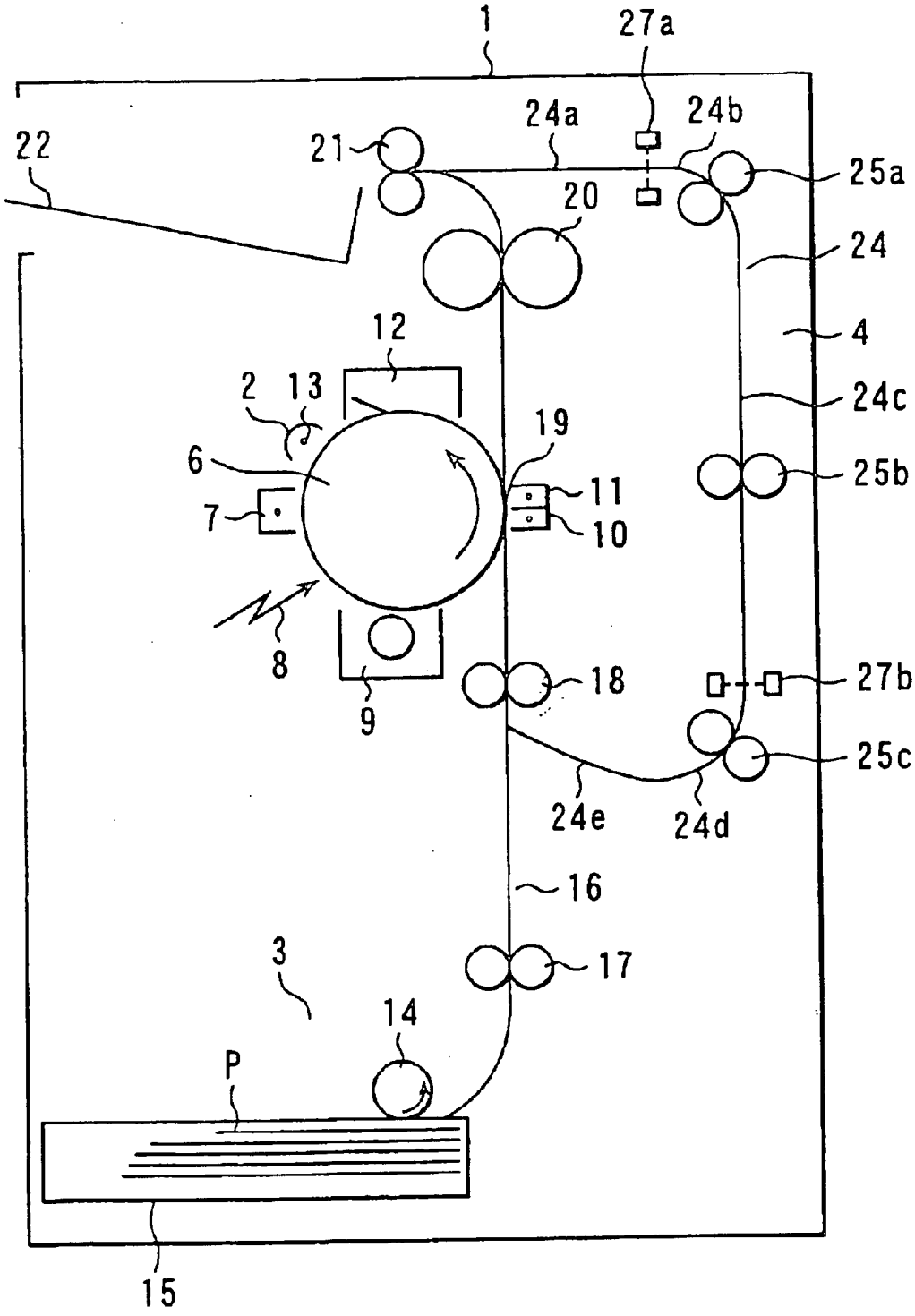
FIG. 1 is a schematic structural view showing an electrophotographic copying machine according to an embodiment of the present invention.
Figure 2:
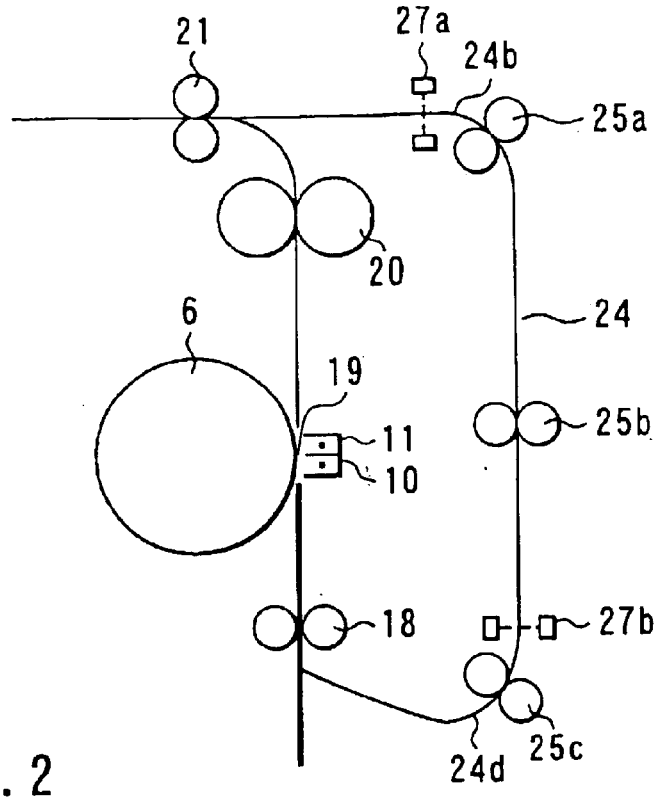
FIG. 2 is a view showing a state in which a paper sheet is being fed to an image transfer section.

In the following, the present invention will be explained with reference to an embodiment shown in the drawings.

FIG. 1 is a structural view showing an electrophotographic machine as an image forming apparatus according to an embodiment of the present invention.

The electrophotographic machine comprises an apparatus body 1. An image forming section 2 for forming an image on a paper sheet as an object to be carried (e.g., a transfer-target material) in an electrostatic photographic method, a sheet feeder 3 for carrying and supplying a paper sheet for the image forming section 2, and a reverse carrying apparatus 4 for reversing the front and back surfaces of the paper sheet and for returning the paper sheet to the sheet feeder 3. Since the reverse carrying apparatus 4 does not comprise an intermediate tray, the apparatus serves as a so-called non-stack ADU.

The image forming section 2 comprises rotatably a photosensitive drum 6 as an image carrier. Provided in the peripheral part of the photosensitive drum 6 along the rotating direction of the drum are members for executing a so-called electrostatic photographic process by means of a process CPU (not shown).

More specifically, the photosensitive drum 6 is constructed by an application type OPC charged in the minus polarity, and this photosensitive drum 6 includes a conductive base member and a photosensitive layer covering the surface of the conductive base member. The photosensitive layer has a film thickness of 15 to 30 $\mu$m and a dielectric constant of 2.0 to 5.0. The conductive base member of the photosensitive drum 6 is grounded.

Provided in the peripheral part of the photosensitive drum 6 along the rotating direction thereof are a charger 7, an optical scanning system (not shown) for emitting imaging light 8, a developing device 9, a transfer device 10, a separator 11, a cleaning device 12, and a discharger 13.

The sheet feeder 3 includes a sheet feed cassette 15 and a carrying route 16 for carrying a paper sheet supplied from the sheet feed cassette 15 to the upside. Paper sheets P are contained in the sheet feed cassette 15, and are fed one after another by rotation of the sheet feed roller 14.

The carrying route 16 is provided along the vertical direction. Paired carrying rollers 17, paired resist rollers 18, an image transfer section 19, paired fixing rollers 20, and paired discharge rollers 21 are provided respectively from the side of the lower part to the side of the upper part on the carrying route 16. A sheet discharge tray 22 is provided in the side of the paired discharge rollers 21 in which paper sheets are discharged.

The reverse carrying device 4 has a reverse carrying route 24 which connects the sheet discharge side of the paired rollers 20 with the sheet introducing side of the paired resist rollers 18. The reverse carrying route 24 is constructed by a horizontal part 24*a*, a corner part 24*b* in the upper side, a vertical part 24*c*, a corner part 24*d* in the lower side, and a substantial horizontal part 24*e*. The corner part 24*b* in the upper side, the vertical part 24*c*, and the corner part 24*d* in the lower side are respectively provided with pairs of carrying rollers 25*a*, 25*b*, and 25*c*.

Meanwhile, upper and lower detection sensors 27*a* and 27*b* are provided in the upstream sides of the paired rollers 25*a* and 25*c* provided at the upper and lower corner parts 24*b* and 24*d* in the sheet carrying direction.

Figure 10:
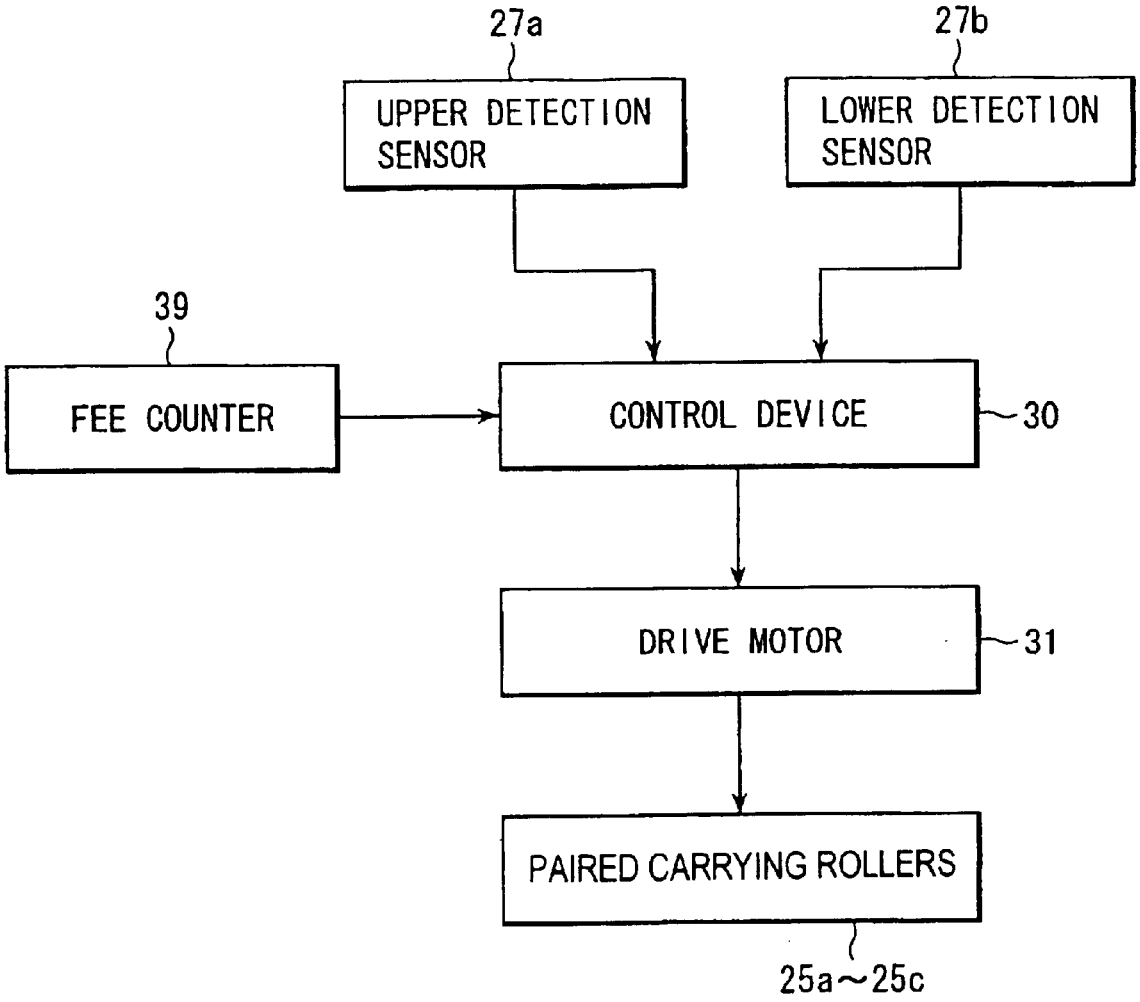
FIG. 10 is a block diagram showing the drive control system for paired carrying rollers on the reverse carrying route.

FIG. 10 is a block diagram showing the drive control system of the reverse carrying apparatus 4.

The upper and lower detection sensors 27*a* and 27*b* are connected to a control device 30 through a signal circuit, and the control device 30 is connected to a drive motor 31 through a control circuit. The drive motor 31 serves to rotate and drive the pairs of carrying rollers 25*a* to 25*c*.

Also, the control device 30 is connected with a fee counter 39 through a signal circuit. The fee counter 39 is attached to an accounting device such as a coin controller or the like which will be explained later. The fee counter 39 counts inserted money and calculates the balance remaining.

The control device 30 receives a money insertion signal or a no-balance signal concerning the fee, thereby to control driving of the paired carrying rollers 25*a* to 25*c* on the reverse carry route 24.

Next, explanation will be made of a double-side image forming operation with reference to FIGS. 1 to 9.

When forming images on both sides, the surface of the photosensitive drum 6 is charged by the charger 7 at first, and imaging light 8 is irradiated on the surface of the charged photosensitive drum 6, so that an electrostatic latent image corresponding to an original document image is formed on the surface of the charged photosensitive drum 6. This electrostatic latent image is sent to the developing device 9 by rotation of the photosensitive drum 6 and is supplied with magnetic toner as a developing agent from the developing device 9, to form a magnetic toner image.

Figure 3:
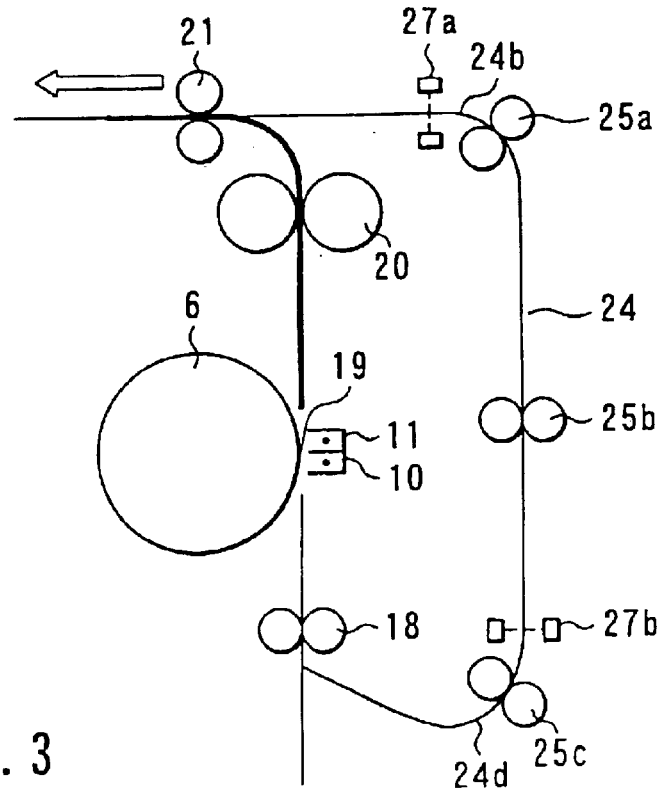
FIG. 3 is a view showing a state in which a paper sheet is being fed out with an image transferred thereto.

At this time, a paper sheet P is supplied by rotation of the sheet feed roller 14 and is clamped and carried by the paired carrying rollers 17. This paper sheet P is aligned by the paired resist rollers 18 and is thereafter supplied to the image transfer section 19 between the photosensitive drum 6 and the transfer device 10. Here, the magnetic toner image on the photosensitive drum 6 is transferred to the paper sheet P. The paper sheet P on which the magnetic toner image has been transferred is separated from the photosensitive drum 6 and carried by the operation of the separator 11. As shown in FIG. 3, this paper sheet is then supplied to the paired fixing rollers 20 where the transferred toner image is fixed to the paper sheet P and is fed out toward the discharge tray 22.

Figure 4:
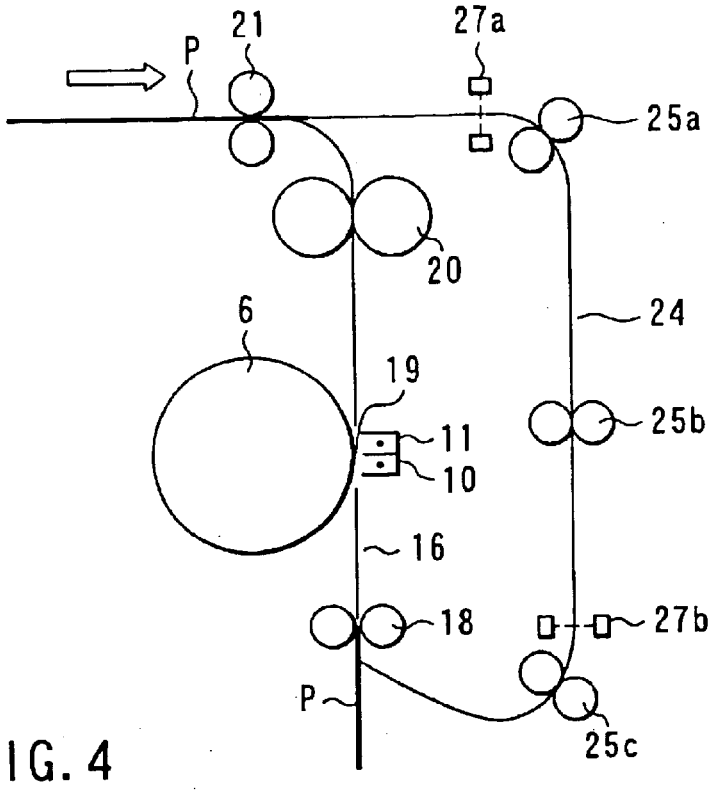
FIG. 4 is a view showing a state in which the paper sheet fed out from the image transfer section is being fed in the reverse direction, and a following paper sheet is being fed into the image transfer section.
Figure 5:
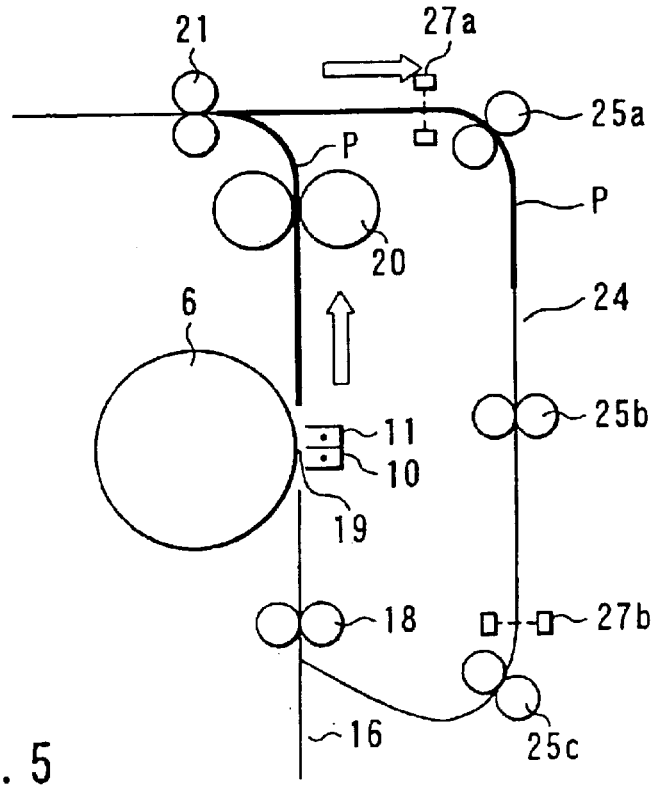
FIG. 5 is a view showing a state in which the paper sheet fed in the reverse direction is being fed into a reverse carrying route, and a following paper sheet is being fed out with an image transferred thereto.
Figure 6:
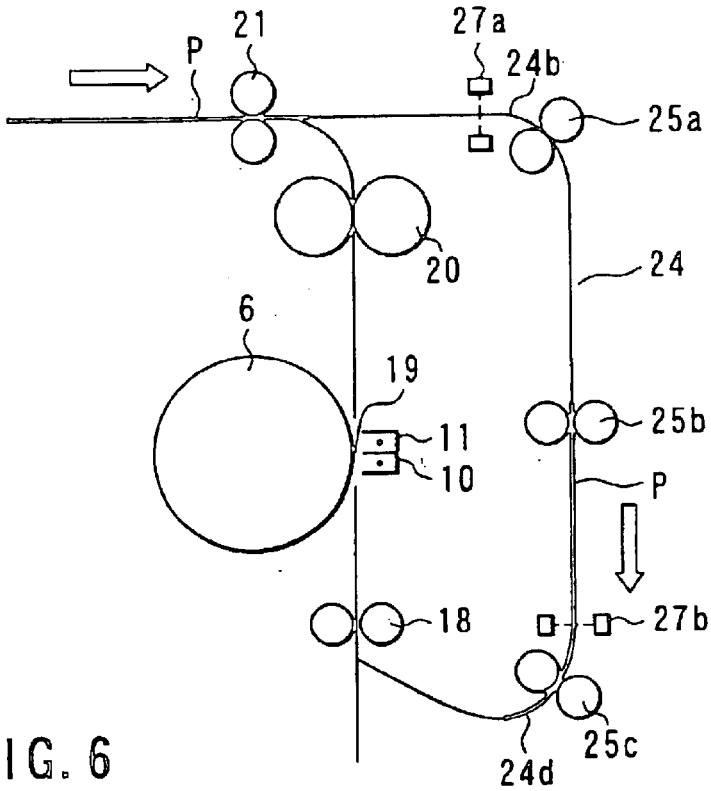
FIG. 6 is a view showing a state in which the paper sheet fed into the reverse carrying route is being carried, and the following paper sheet is being fed in the reverse direction.
Figure 7:
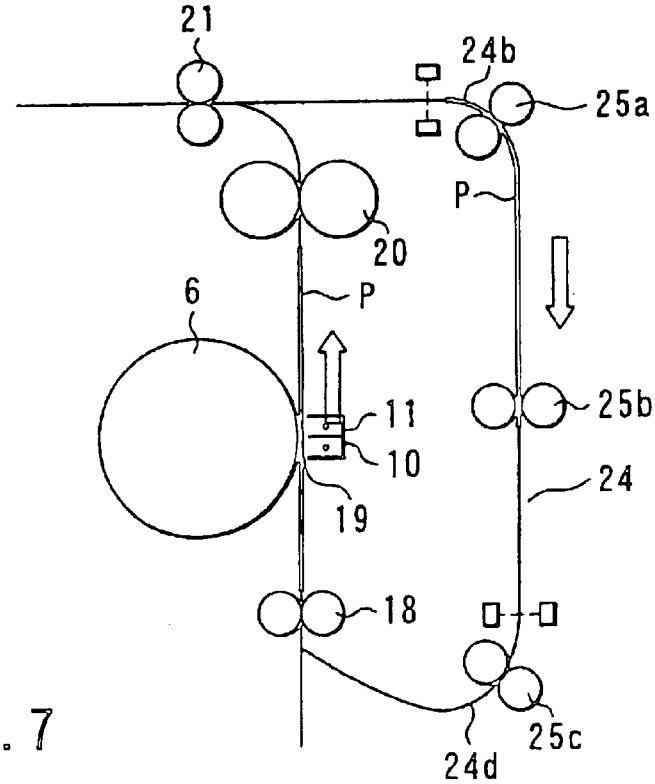
FIG. 7 is a view showing a state in which an image is being transferred to the back surface of the paper sheet fed out from the reverse carrying route, and the following paper sheet is being fed into the reverse carrying route and carried.

After the paper sheet P is fed by a predetermined amount, the paper sheet P is fed in the reverse direction, as shown in FIG. 4, and a following paper sheet P is carried along the carrying route 16. Subsequently, as shown in FIG. 5, the preceding paper sheet P is carried out along the reverse carrying route 24, and a toner image on the photosensitive drum 6 is transferred to the following paper sheet P which is then fed out. After the following paper sheet P is fed by a predetermined amount, it is also fed in the reverse direction as shown in FIG. 6 while the preceding paper sheet P is also carried continuously along the reverse carrying route 24. Thereafter, the preceding paper sheet P is fed into the image transfer section 19, reversed as shown in FIG. 7, and a toner image is transferred to the back surface thereof. The following paper sheet P is carried along the reverse carrying route 24.

Figure 8:
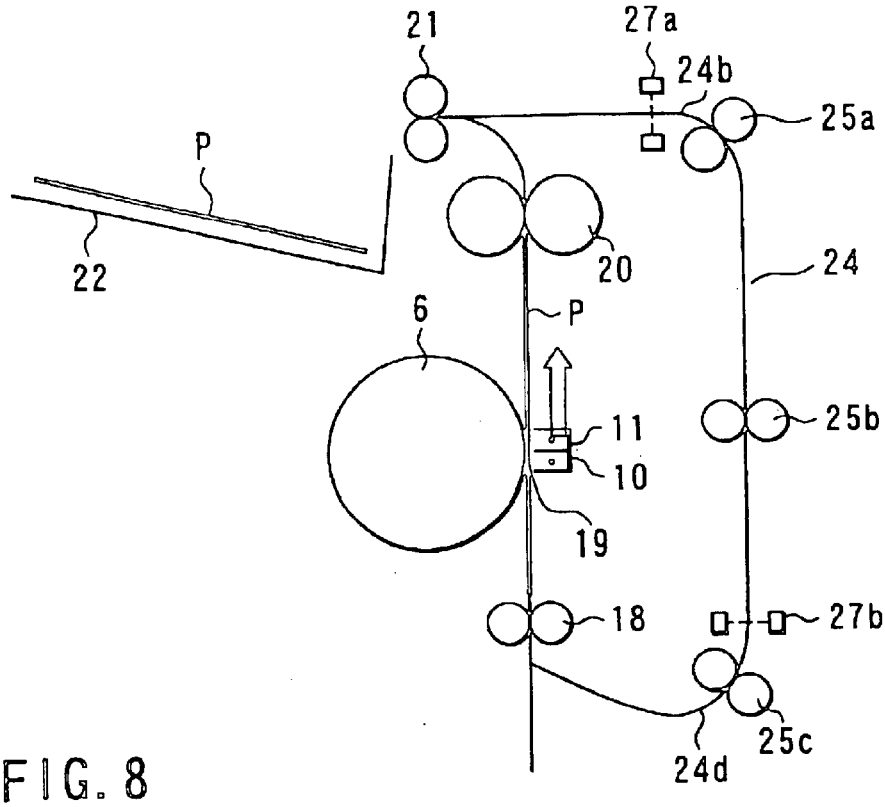
FIG. 8 is a view showing a state in which the paper sheet with an image formed on its back surface is being discharged onto a sheet discharge tray, and an image is being transferred to the back surface of the following paper sheet and carried.
Figure 9:
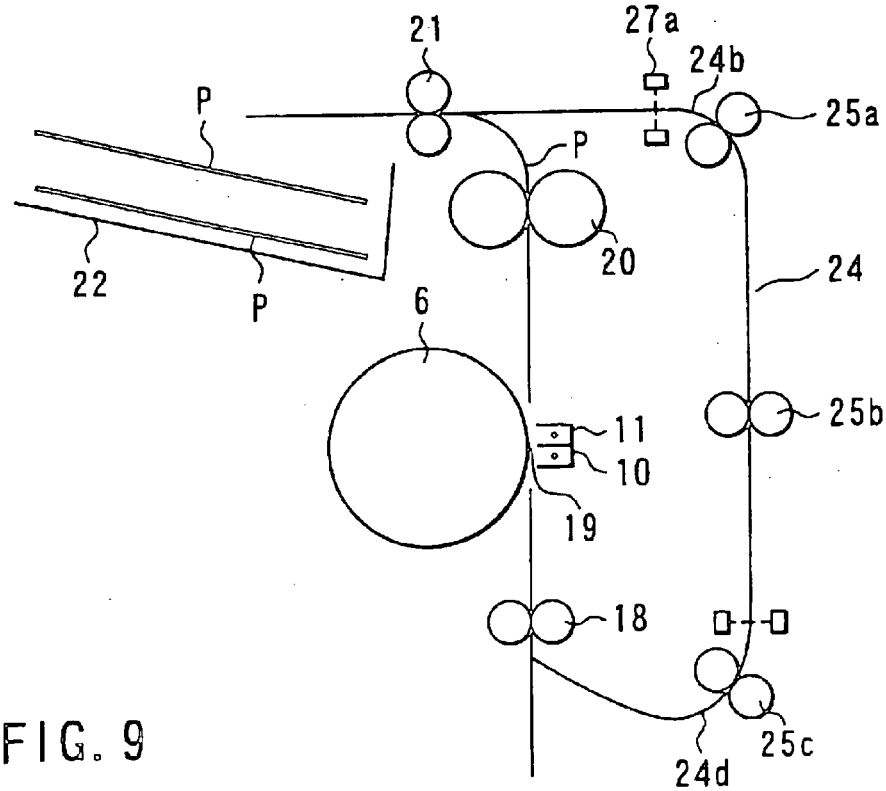
FIG. 9 is a view showing a state in which the following paper sheet with an image formed on its back surface is discharged onto the sheet discharge tray.

The preceding paper sheet P with a toner image transferred to its back surface is discharged onto the discharge tray 22, as shown in FIG. 8. At this time, the following paper sheet P reversed is fed to the image transfer section 19, and a toner image is transferred to its back surface. Thereafter, the following paper sheet P is fed as shown in FIG. 9, and is carried out onto the discharge tray 22.

Meanwhile, there is a case of using the above-described stack-less ADU attached with an accounting device such as a coin controller. For example, if data of four pages should be printed on both surfaces of two paper sheets by an electrophotographic copying machine, there is a case that money runs short at the time point when printing of the first, second, and fourth pages are finished. In this case, the paper sheets will be directly discharged without printing the third page or will be kept on the reverse carrying route 24.

However, it would be unkind to the user to discharge the paper sheets P without printing the third page.

Otherwise, if the paper sheet P is kept on the reverse carrying route 24, the paper sheet P may be positioned at the corner part 24*b* (or 24*d*) of the reverse carrying route 24. If a paper sheet P is positioned at the corner part 24*b* (or 24*d*), the paper sheet P is curled along the corner part 24*b* (or 24*d*).

Hence, in the present invention, if a paper sheet P is positioned at a corner part 24*b* (or 24*d*) and detected by a detection sensor 27*a* (or 27*b*) when the paper sheet P is kept, a detection signal from the sensor is transmitted to the control device 30. Upon transmission of the detection signal, the control device 30 does not stop but continues rotating the paired carrying rollers 25*a*, 25*b*, and 25*c* by the drive motor 31. As a result, the paper sheet P is fed from the corner part 24*b* (or 24*d*). Accordingly, the detection sensor 27*a* (or 27*b*) does not detect the paper sheet P any more, and the control device 30 then stops the drive motor 31 to stop rotating the paired carrying rollers 25*a*, 25*b*, and 25*c*.

As described above, in the present invention, if a paper sheet P is positioned at the corner part 24*b* (or 24*d*) and detected by the detection sensor 27*a* (or 27*b*) when the paper sheet is temporarily kept on the reverse carrying route 24, the paired carrying rollers 25*a*, 25*b*, and 25*c* are kept rotating until the paper sheet P is fed out from the corner part 24*b* (or 24*d*). Therefore, no paper sheet P stays at the corner part 24*b* (or 24*d*), so that curling of paper sheets P can be prevented.

Accordingly, paper sheets P can be maintained in an excellent condition, and failures in transfer of images can be prevented. In addition, the occurrence of jamming during carrying can be prevented, and paper sheets can be discharged in an orderly fashion.

In the above embodiments, the detection sensors 27*a* and 27*b* are respectively provided on the upstream sides of the paired carrying rollers 25*a* and 25*c* in the sheet carrying direction. The present invention, however, is not limited hitherto. The sensors may be respectively provided in the downstream sides of the paired carrying rollers 25*a* and 25*c* or may be respectively provided in the upstream and downstream sides of the paired carrying rollers 25*a* and 25*c* in the sheet carrying direction.

Further, one or more detection sensors may be provided between the upper and lower corner parts 24*b* and 24*d* on the reverse carrying route 24 so that a paper sheet P can be detected steadily.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an apparatus body;

an image carrier provided in the apparatus body, which carries an image;

a first carrying path substantially vertically provided in the apparatus body, on which an object is carried to the image carrier;

a transfer device provided opposite to the image carrier with the first carrying path interposing therebetween, which transfers the image to the object which is carried through the first carrying path;

a resist roller provided on the first carrying path, being located in an upstream side of the transfer device;

a discharge section which receives an object, onto both surfaces of which an image is transferred by the transfer device, carried from the first carrying path;

a carrying device for carrying an object, onto one surface of which an image is transferred by the transfer device, toward the discharge section by a predetermined distance, and then carrying the object in a direction away from the discharge section; and a second carrying path on which the object carried in the direction away from the discharge section by the carrying device is guided from a downstream side of the transfer device of the first carrying path and is guided in an inverted state to an upstream side of the resist roller, the second carrying path having a parallel portion which is substantially parallel to the first carrying path and curved portions each provided upstream and downstream from the parallel portion, and the second carrying path having a first roller pair located at the curved portion upstream from the parallel portion, a second roller pair located at the curved portion downstream from the parallel portion, and a third roller pair located at the parallel portion.

2. An image forming apparatus according to claim 1, wherein the third roller pair is provided at a substantially center portion of the second carrying path.

3. An image forming apparatus according to claim 1, further comprising a detection sensor for detecting the object, the detection sensor being provided in the vicinity of each of the first and second roller pairs.

4. An image forming apparatus according to claim 1, wherein the second carrying path connects the downstream side and the upstream side in the object carrying direction of the first carrying path, and forms a loop in incorporating with the first carrying path.

5. An image forming apparatus according to claim 4, further comprising:

a sheet feed device for feeding the object to the first carrying path, the sheet feed device being provided outside the loop formed of the first and second carrying paths.

6. An image forming apparatus comprising:

an apparatus body;

a sheet feed roller provided in the apparatus body, which feeds an object onto which an image is to be transferred;

a substantially vertical first carrying path on which the object fed by the sheet feeding roller is carried;

a resist roller which aligns the object carried by the first carrying path;

an image carrier which carries an image;

a transfer section which transfers the image onto the aligned object;

a fixing section which fixes the transferred image on the aligned object;

a receiving section which receives the object on both surfaces of which the image is transferred, discharged from the first carrying path;

a discharge roller pair which sends an object, on one surface of which an image is fixed by the fixing section, toward the receiving section by a predetermined distance, and then, sends the object in the direction away from the receiving section to guide the object to a predetermined direction from a position downstream with respect to the fixing section; and a second carrying path on which the object sent by the discharge roller pair is guided upstream from the resist roller in a state where the object is inverted, the second carrying path having a parallel portion which is substantially parallel to the first carrying path and curved portions each provided upstream and downstream from the parallel portion, and having a first roller pair located at the curved portion upstream from the parallel portion, a second roller pair located at the curved portion downstream from the parallel portion, and a third roller pair located at the parallel portion.

7. An image forming apparatus according to claim 6, wherein the second carrying path has first and second sensors for detecting an object onto which an image is to be transferred.

8. An image forming apparatus according to claim 7, wherein the first sensor is provided in the vicinity of a beginning portion of the second carrying path, and the second sensor is provided in the vicinity of an end portion of the second carrying path.

9. An image forming method comprising:

carrying an object onto which an image is to be transferred through a first carrying path substantially vertically provided in an apparatus body, and feeding the object to an image carrier which carries an image, after the object is aligned by a resist roller;

transferring an image carried by the image carrier onto the object carried to the image carrier by the transfer device;

receiving the object by a discharge section, on both surfaces of which the image has been transferred by the transfer device, discharged from the first carrying path;

carrying the object by a carrying device, onto one surface of which the image has been transferred by the transfer device, toward the discharge section by a predetermined distance, and then carrying it in a direction away from the discharge section; and guiding the object carried in the direction away from the discharge section by the carrying device on a second carrying path from a downstream side of the transfer device of the first carrying path, and guiding it in an inverted state to an upstream side of the resist roller, the second carrying path having a parallel portion which is substantially parallel to the first carrying path and curved portions each provided upstream and downstream from the parallel portion, and having a first roller pair located at the curved portion upstream from the parallel portion, a second roller pair located at the curved portion downstream from the parallel portion, and a third roller pair located at the parallel portion.

* * * * *